United States Patent [19]

Davis et al.

[11] Patent Number: 5,037,226

[45] Date of Patent: Aug. 6, 1991

[54] ENVELOPE SEALER APPARATUS

[76] Inventors: Linda K. Davis; Melvin L. Brown, both of 1017 Landee Way, Modesto, Calif.

[21] Appl. No.: 568,904

[22] Filed: Aug. 17, 1990

[51] Int. Cl.[5] ..... A46B 11/00

[52] U.S. Cl. ..... 401/122; 156/441.5; 220/85 H; 401/119; 401/130

[58] Field of Search ..... 401/5, 24, 26, 89, 121, 401/124, 244, 98, 115, 107, 108, 125, 235, 262, 266, 223, 225, 265, 48, 130, 131, 145, 152, 158, 122, 119; 220/85 H

[56] References Cited

U.S. PATENT DOCUMENTS

| | | | |
|---|---|---|---|
| 945,982 | 1/1910 | Pomphrey | 401/262 |
| 1,655,719 | 1/1928 | Wilkinson | 401/265 |
| 3,013,691 | 12/1961 | Prentice | 220/85 H |
| 3,756,732 | 9/1973 | Stoffler | 401/262 X |

FOREIGN PATENT DOCUMENTS

| | | | |
|---|---|---|---|
| 2064314 | 6/1981 | United Kingdom | 401/121 |

*Primary Examiner*—David A. Simmons
*Assistant Examiner*—Robert Barker
*Attorney, Agent, or Firm*—Leon Gilden

[57] ABSTRACT

Apparatus including elongate longitudinally aligned housing with an upper web defining a cavity within the housing wherein the web includes a threaded opening to threadedly receive a threaded portion of the elongate shank. The elongate shank includes a sponge member at a lower terminal end thereof wherein the sponge member receives moisture from fluid contained within the cavity. Modifications of the invention include an intermediate cap including spaced rods overlying the threaded opening to permit squeezing of excess moisture from the sponge. Further, the elongate shaft may include a plurality of spaced openings defining a lower opening and upper opening to permit the shaft to contain fluid and provide continuous remoistening of the sponge during use.

4 Claims, 5 Drawing Sheets

PRIOR ART

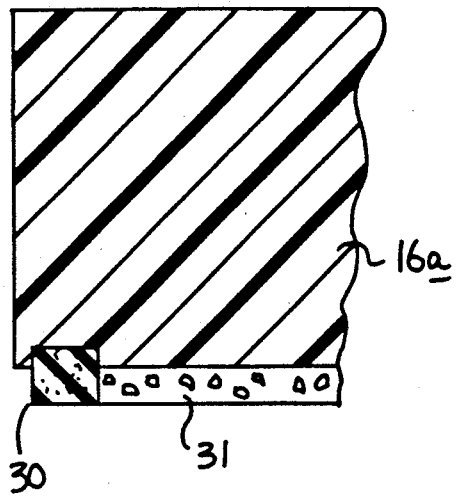
Fig 6
Fig 7
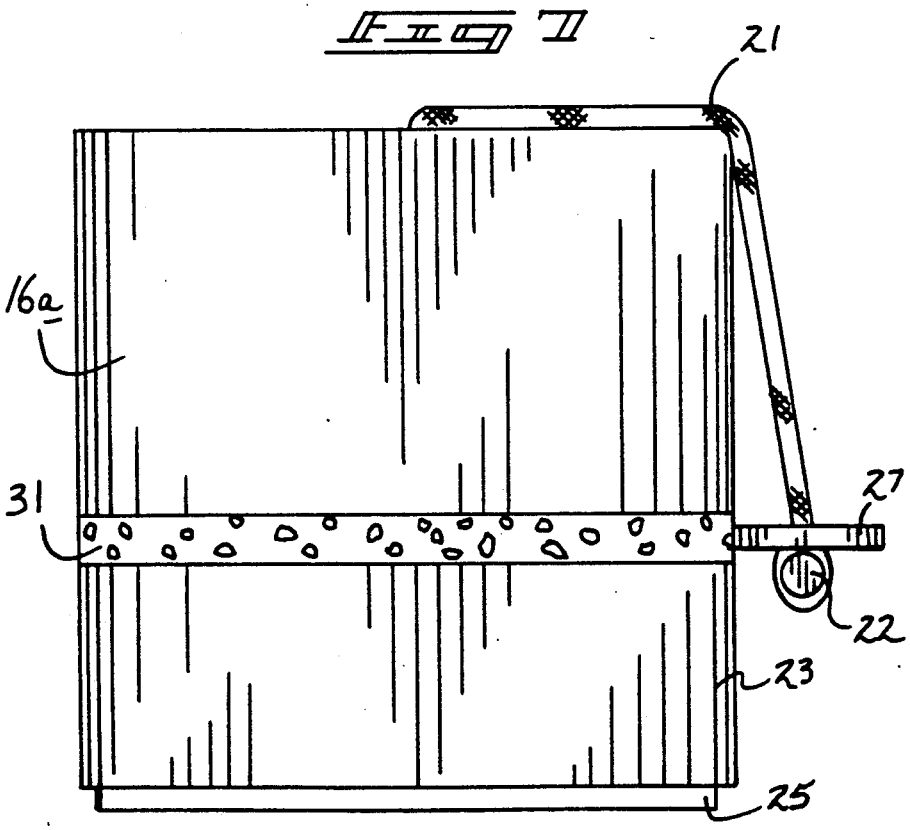

ENVELOPE SEALER APPARATUS

BACKGROUND OF THE INVENTION

1. Field of the invention

The field of the invention relates to envelope sealer apparatus, and more particularly pertains to a new and improved envelope sealer apparatus wherein the same provides for an easily manipulated shaft member to receive moisture from a fluid container for continuous moistening of envelopes for their sealing.

2. Description of the Prior Art

Various envelope sealing apparatus has been utilized in the prior art. Heretofore however such organizations have been of a relatively cumbersome structure and have typically utilized exposed moistening surfaces that are of cumbersome storage and positioning during periods of non-use. The instant invention attempts to overcome deficiencies of the prior art by providing an organization that includes a self contained reservoir of fluid arranged in a free standing position removed from inadvertent spillage during periods of non-use. Examples of the prior art include U.S. Pat. No. 611,934 to FLETCHER where an envelope moisture and sealer includes a lower receptacle and a sponge surface defining a reactive surface to an overlying plate to effect sealing of an envelope flap positioned therewithin.

U.S. Pat. No. 4,180,430 to GELMAN provides for a portable envelope sealing device wherein a lower base member includes a recess positionable against a flap of an envelope to effect moistening of the flap for sealing of the envelope.

U.S. Pat. No. 1,117,387 to HUMPHREY provides for an envelope sealing device wherein a wick like member is positionable upon an overlying plate to draw moisture from an underlying reservoir.

U.S. Pat. No. 1,767,908 to ZUCKERMAN, JR. provides for an envelope sealer vertically arranged with a slot to direct an envelope flap therethrough for moistening of the flap.

U.S. Pat. No. 4,643,123 to AUERBACH provides for an envelope flap moistening apparatus with a slotted opening to provide a brush member to direct a flap into contact with an underlying sponge that is in communication with a fluid reservoir for moistening and subsequent sealing of the envelope flap.

As such, it may be appreciated that there continues to be a need for a new and improved envelope sealer apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of envelope sealer apparatus present in the prior art, the present invention provides a new and improved envelope sealer apparatus wherein the same provides a self contained reservoir and a readily removable applicator to effect selective moistening and sealing of an envelope member. As such, the general purpose of the present invention, which will be described subsequently in greater detail, is to provide a new and improved envelope sealer apparatus which has all the advantages of the prior art envelope sealer apparatus and none of the disadvantages.

To attain this, the envelope sealer apparatus of the invention includes apparatus including elongate longitudinally aligned housing with an upper web defining a cavity within the housing wherein the web includes a threaded opening to threadedly receive a threaded portion of the elongate shank. The elongate shank includes a sponge member at a lower terminal end thereof wherein the sponge member receives moisture from fluid contained within the cavity. Modifications of the invention include an intermediate cap including spaced rods overlying the threaded opening to permit squeezing of excess moisture from the sponge. Further, the elongate shaft may include a plurality of spaced openings defining a lower opening and upper opening to permit the shaft to contain fluid and provide continuous remoistening of the sponge during use.

There has thus been outlined, rather broadly, the more important features of the invention in order that the detailed description thereof that follows may be better understood, and in order that the present contribution to the art may be better appreciated. There are, of course, additional features of the invention that will be described hereinafter an which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved envelope sealer apparatus which has all the advantages of the prior art envelope sealer apparatus and none of the disadvantages.

It is another object of the present invention to provide a new and improved envelope sealer apparatus which may be easily and efficiently manufactured and marketed.

It is a further object of the present invention to provide a new and improved envelope sealer apparatus which is of a durable and reliable construction.

An even further object of the present invention is to provide a new and improved envelope sealer apparatus which is susceptible of a low cost of manufacture with regard to both materials and labor, and which accordingly is then susceptible of low prices of sale to the consuming public, thereby making such envelope sealer apparatus economically available to the buying public.

Still yet another object of the present invention is to provide a new and improved envelope sealer apparatus which provides in the apparatuses and methods of the prior art some of the advantages thereof, while simultaneously overcoming some of the disadvantages normally associated therewith.

Still another object of the present invention is to provide a new and improved envelope sealer apparatus which may be compactly stored when not being utilized.

Yet another object of the present invention is to provide a new and improved envelope sealer apparatus wherein the same provides for a reservoir and a removable applicator member to permit ease of manual manipulation of a sponge applicator surface of the applicator to an associated envelope.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an orthographic view taken along the lines 6—6 of FIG. 5 in the direction indicated by the arrows.

FIG. 7 is an orthographic side view taken in elevation of the cap structure utilized by the modification of the instant invention.

DESCRIPTION OF THE PREFERRED EMBODIMENT

Figure 1:
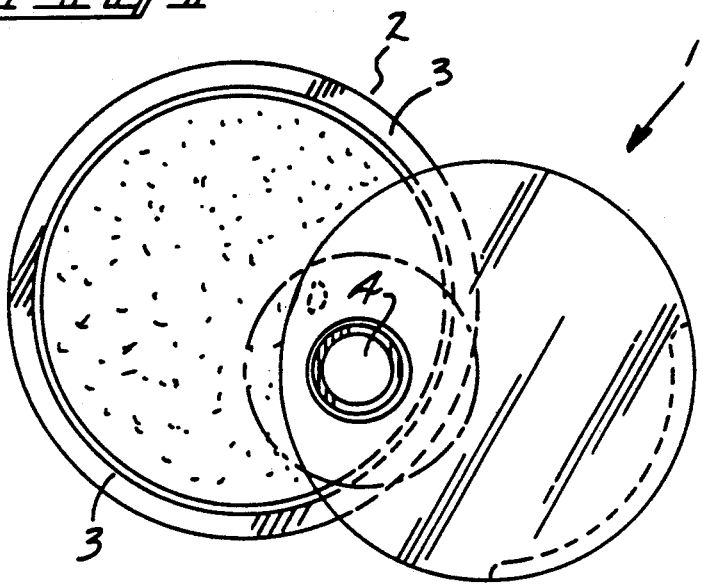
FIG. 1 is an orthographic top view of a prior art envelope sealer apparatus.

With reference now to the drawings, and in particular to FIGS. 1 to 9 thereof, a new and improved envelope sealer apparatus embodying the principles and concepts of the present invention and generally designated by the reference numeral 10 will be described.

Figure 2:
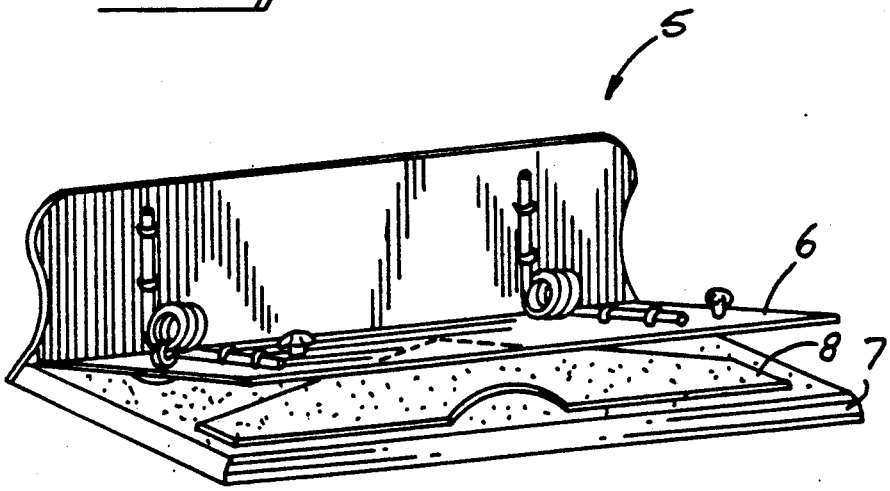
PRIOR ART Fig 2
FIG. 2 is an isometric illustration of a further prior art envelope sealer apparatus.
Figure 3:
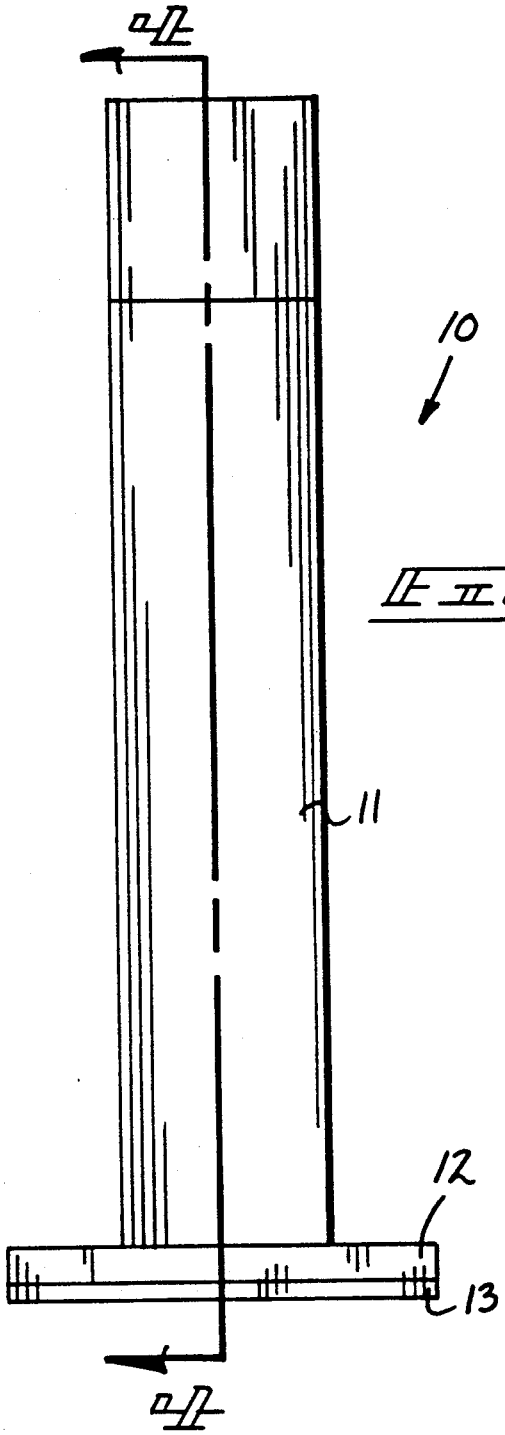
FIG. 3 is an orthographic side view taken in elevation of the instant invention.
Figure 4:
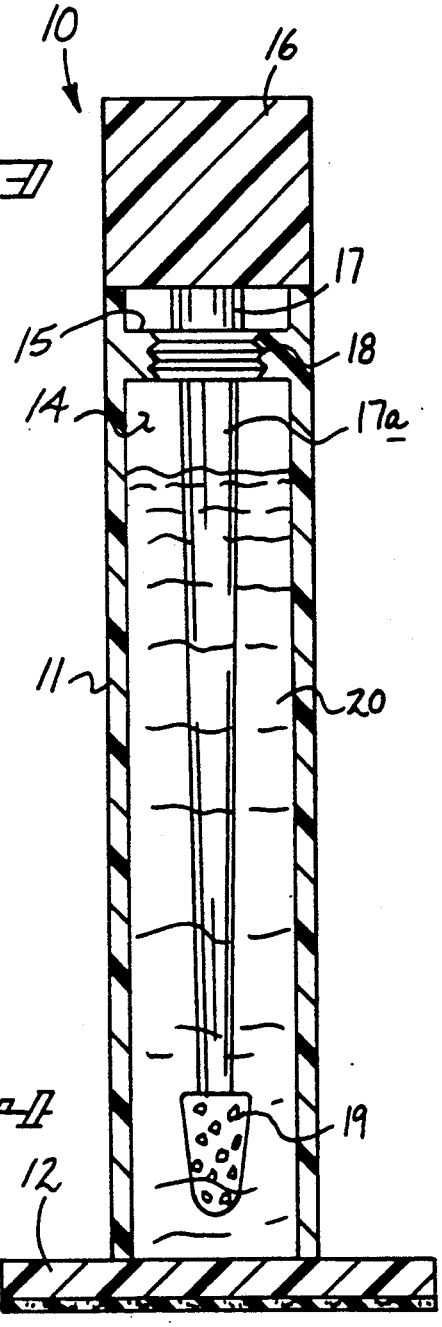
FIG. 4 is an orthographic view taken along the lines 4—4 of FIG. 3 in the direction indicated by the arrows.

FIG. 1 illustrates a prior art envelope sealer apparatus as exemplified in U.S. Pat. No. 4,180,430 wherein fluid is directed through an opening 4 into an underlying sponge member that directs fluid to recess portions 3 of a rim 2 to permit positioning of the recess portion underlying envelope flap for moistening thereof. FIG. 2 illustrates a further prior art envelope sealing apparatus 5 wherein a receptacle 7 includes an underlying sponge member 8 to position an envelope flap to the sponge member 8 and overlying plate portion 6 in a manner as set forth in U.S. Pat. No. 611,934.

More specifically, the envelope sealer apparatus 10 of the instant invention essentially comprises an elongate longitudinally aligned body member 11 including a pedestal base 12 orthogonally and integrally mounted to a bottom surface of the body member 11 wherein the pedestal base including a non-slip friction pad 13 laminated to a bottom surface of the pedestal base 12 The friction pad 13 is a relatively low durometer rating relative to the pedestal base to provide frictional engagement with an underlying surface (not shown) to insure vertical alignment of the body member during its positioning upon the support surface. The body member 11 includes an elongate cavity 14 formed within the body member with the cavity including a web 15 orthogonally mounted adjacent an upper end of the body member with the web 15 including a threaded opening coaxially aligned with the axis of the body member 11. A cap handle member 16 includes an elongate shaft 17 integrally and orthogonally mounted to a bottom surface of the handle member 16 including a lower shaft portion **17*a* demarcated by a threaded shaft portion 18 cooperating with the threaded opening of the web 15. A sponge applicator 19 defined by a conical configuration is mounted to a lower terminal end of the elongate shaft 17. The lower shaft portion 17*a* is defined by a predetermined shaft length substantially equal to or somewhat less than the predetermined axial length of the cavity 14 to position the sponge applicator 19 adjacent the floor of the body member 11 defined by the pedestal base 12. A moisturizing fluid 20 is provided within the cavity 14 whereupon threaded disengagement of the threaded shaft portion 18 from the threaded opening permits application of the sponge applicator 19** to an envelope (not shown) for moistening and subsequent sealing thereof.

Figure 5:
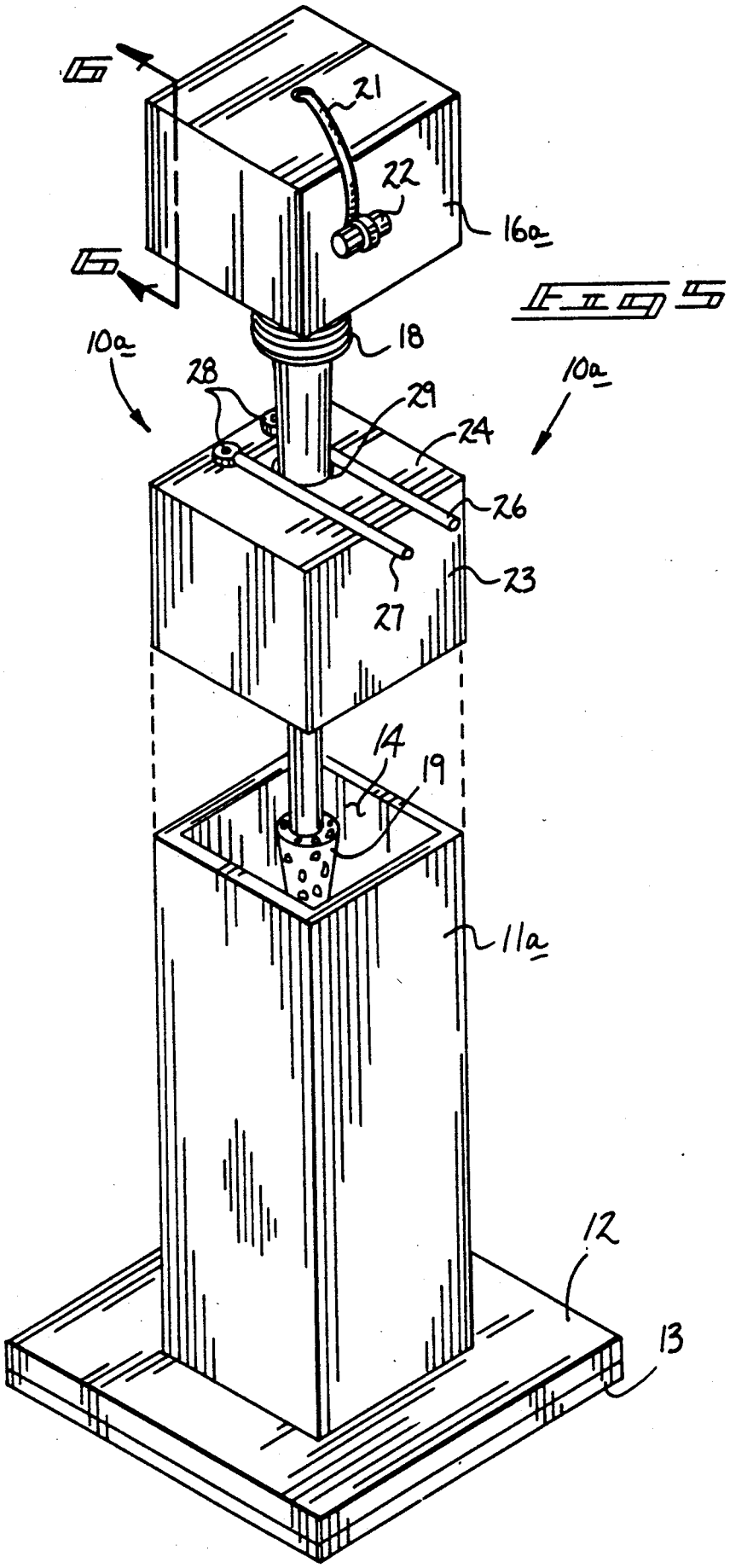
FIG. 5 is an isometric illustration of a modification of the instant invention.

FIG. 5 illustrates a modified envelope sealer apparatus **10*a* including a modified longitudinally aligned body member 11*a* with the longitudinally aligned body member 11*a* including the pedestal base 12 and the friction pad 13 mounted to the lower terminal end thereof with the elongate cavity 14 formed therewithin. The upper terminal end of the modified body member 11*a* is open and receives an intermediate cap 23 formed with a bottom perimeter flange 25 to inter-fit within the cavity of the body member 11 to secure the intermediate cap 23 thereon. The intermediate cap 23 includes a top surface 24 with the top surface 24 including a plurality of rods defined by a first and second rod member 26 and 27 each pivotally mounted at a rear terminal end thereof to the top surface 24 and overlying the threaded ca opening 29 that cooperates with the threaded shaft portion 18. The first and second rod members 26 and 27 may be manually engaged and depressed towards one another to provide pressure against the sponge applicator 19 upon withdrawal through the intermediate cap threaded opening 29 to remove excess fluid therefrom. The organization includes a modified handle member 16*a* that integrally and orthogonally mounts the elongate shaft 17 thereto. A top surface of the modified handle 16*a* includes an elastomeric cord 21 directed coaxially therefrom mounting a rod member 22 at a free terminal end thereof spaced from the top surface of the modified cap 16*a*. Reference to FIG. 7 illustrates that the elastomeric cord 21 is stretched with the rod member 22 positioned underlying the first and second rod members 26 and 27 to lock the modified cap 16*a* to the intermediate cap 23. A bottom surface of the modified cap 16*a* includes a sponge layer 31 with a perimeter "o"-ring 30 coextensively formed about the sponge layer 31 whereupon securement of the modified cap 16*a* overlying the top surface of the intermediate cap 23 effects a sealing therebetween preventing loss of fluid from the threaded cap opening 29 due to inadvertent tippage and the like of the organization 10***a*. As illustrated, the first and second rod members 26 and 27 utilize a pivot connection 28 at a rear terminal end thereof mounted to the top surface 24 of the intermediate cap 23 to contain the pivot connection 28 to underlie the sponge layer 31 when the modified cap 16*a* is mounted to the top surface 24 of the intermediate cap 23.

Figure 8:
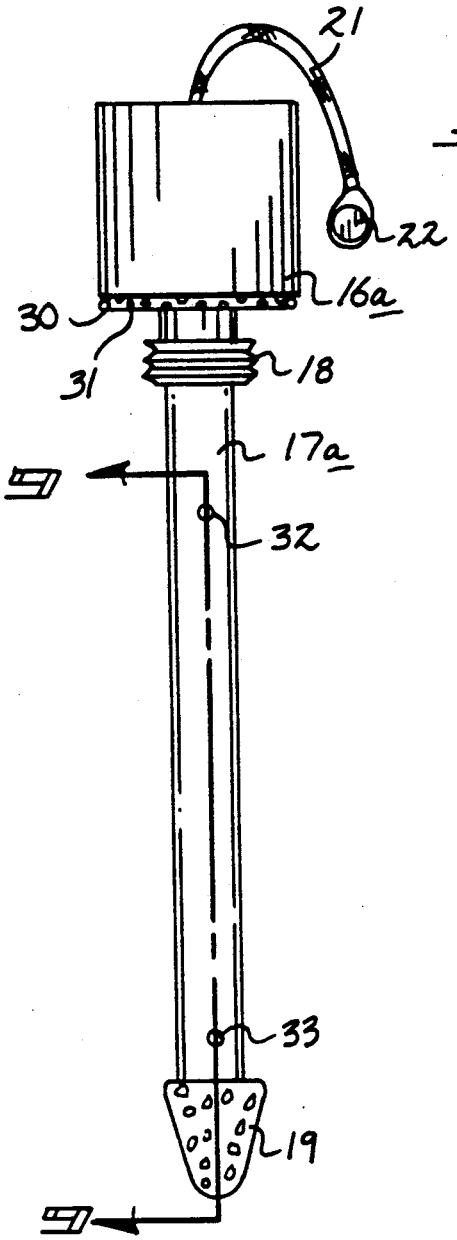
FIG. 8 is an orthographic view taken in elevation of the modified applicator member utilized by the instant invention.
Figure 9:
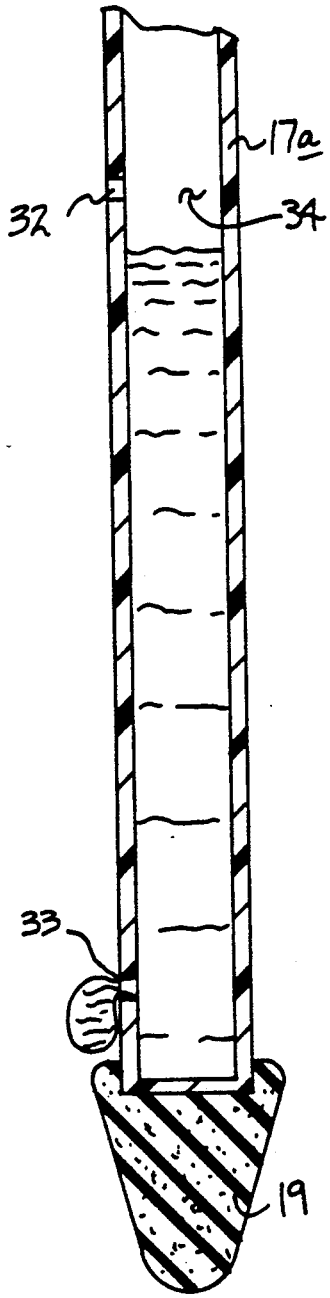
FIG. 9 is an orthographic view taken along the lines 9—9 of FIG. 8 in the direction indicated by the arrows.

FIGS. 8 and 9 illustrate the lower shaft portions 17*a* including an upper shaft air vent aperture 32 and a lower shaft aperture 33 positioned adjacent a lower terminal end of the lower shaft portion 17*a* to permit a metered flow of water onto the sponge 19 with such water or fluid directed into the lower shaft cavity 34 of the lower shaft portion 17*a* when the lower shaft portion 17*a* is immersed within the moisturizing fluid 20 such as water. The metered flow of water as illustrated in FIG. 9 maintains application of fluid to the sponge applicator 19 wherein during constant use thereof, the applicator 19 is constantly moisturized for continuous use to minimize reimmersion of the applicator 19 within the moisturizing fluid 20.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An envelope sealer apparatus comprising in combination:

a longitudinally aligned body member defining an axis directed therethrough with a lower terminal end of the body member including a pedestal base orthogonally and integrally mounted thereto with the pedestal base including a resilient friction pad laminated thereto, and the body member including an elongate cavity coaxially formed within the body member, and an intermediate portion mounted to an upper terminal end of the body member with the intermediate portion including a threaded bore directed therethrough wherein the threaded bore coaxially aligned with the body member, and a cap member overlying the intermediate portion and securable thereto wherein the cap member including an elongate shaft, the elongate shaft including a threaded portion wherein the threaded portion is threadedly receivable within the threaded bore, and the shaft including a lower shaft portion, and a sponge member mounted to a lower terminal end of the lower shaft portion, and wherein the lower shaft portion defined by a lower shaft portion length and a cavity is defined by an axial length wherein the lower shaft portion length is substantially equal to or less than the axial length, and wherein the intermediate portion is removably mounted relative to the upper terminal end of the body member, and the intermediate portion includes a top surface and a bottom surface, the bottom surface including a flange member directed downwardly therefrom wherein the flange member is complementarily receivable within the upper terminal end of the body member to secure the intermediate portion relative to the body member, and the top surface receiving the cap member thereon is coaxial alignment therewith, and wherein the top surface includes a first and second rod, the first and second rod including a rear terminal end with each rear terminal end including a pivot connection mounted to the top surface, and the first and second rod positionable to overlie the threaded bore to effect drainage of excess moisture from the sponge member when the sponge member is directed through the threaded bore between the first and second rod member.

2. Apparatus as set forth in claim 1 wherein the cap member includes a cap member top surface wherein the cap member top surface includes an elastomeric cord mounted fixedly thereto with a forward end of the elastomeric cord spaced from the cap member top surface including a rod member, and the rod member receivable between the first and second rod members when the cap member is mounted to the top surface of the intermediate member and the rod member is positioned underlying the first and second rod member.

3. Apparatus as set forth in claim 2 wherein the cap member includes a cap member bottom surface the cap member bottom surface includes a sponge layer laminated to the cap member bottom surface, and an "o"-ring in surrounding relationship relative to the sponge layer to sealingly maintain moisture within the sponge layer.

4. Apparatus as set forth in claim 3 wherein the lower shaft portion includes a bottom aperture positioned adjacent the sponge applicator and overlying the sponge applicator, and the lower shaft portion including a lower shaft cavity accommodating fluid therewithin, and the lower shaft portion including an upper shaft vent aperture to permit venting within the lower shaft cavity and effect metered flow of fluid onto the sponge applicator.

* * * * *